US006107553A

United States Patent [19]

Deering et al.

[11] Patent Number: 6,107,553

[45] Date of Patent: Aug. 22, 2000

[54] TAILPIECE FOR A BANJO

[76] Inventors: Charles Greg Deering; Janet L. Deering, both of 7936 Lester Ave., Lemon Grove, Calif. 91945

[21] Appl. No.: 09/106,021

[22] Filed: Jun. 29, 1998

[51] Int. Cl.[7] ..... G10D 3/12

[52] U.S. Cl. ..... 84/300

[58] Field of Search ..... 84/300

[56] References Cited

U.S. PATENT DOCUMENTS

D. 191,139 8/1961 Baker .

1,462,359 7/1923 Winship et al. ..... 84/300

1,566,745 12/1925 Grover ..... 84/300

1,615,152 1/1927 Weymann ..... 84/300

*Primary Examiner*—Jeffrey W. Donels

*Attorney, Agent, or Firm*—Frank D. Gilliam

[57] ABSTRACT

A tailpiece for a banjo including an elongated aperture for connection to the vertical surface of the drum assembly and for varying the tailpiece elevation for adaption to different configured drum assemblies. A required bend has nested side walls that are welded at each corner thereof to prevent breakage across the bend caused by string vibration.

5 Claims, 1 Drawing Sheet

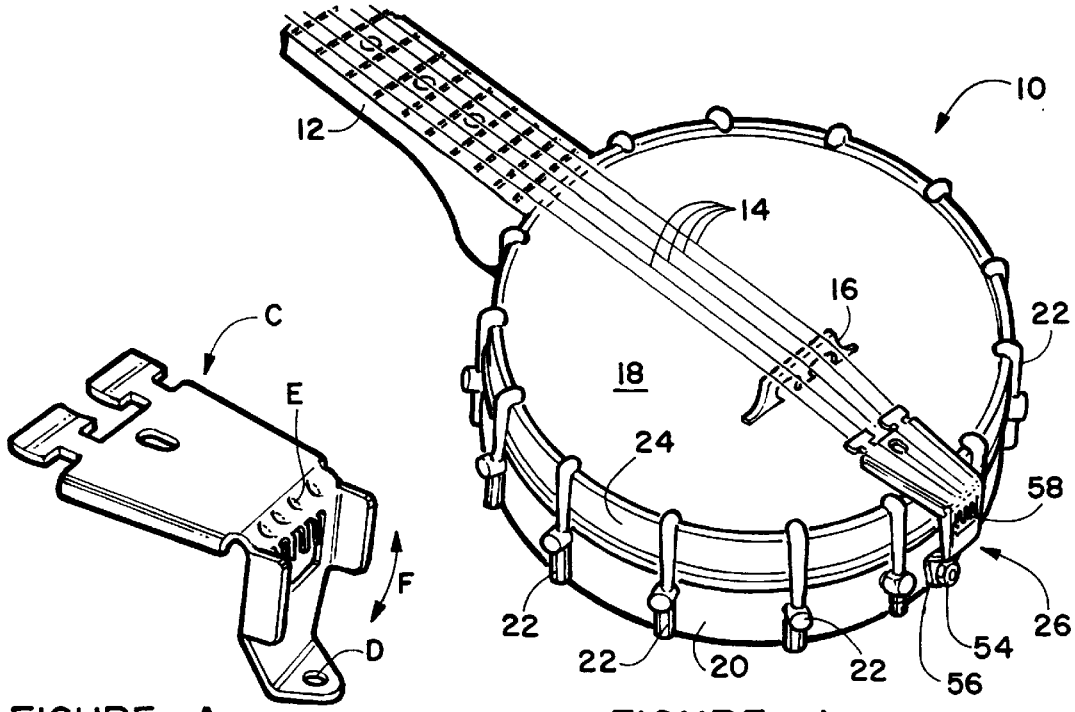
FIGURE 1
FIGURE A
PRIOR ART
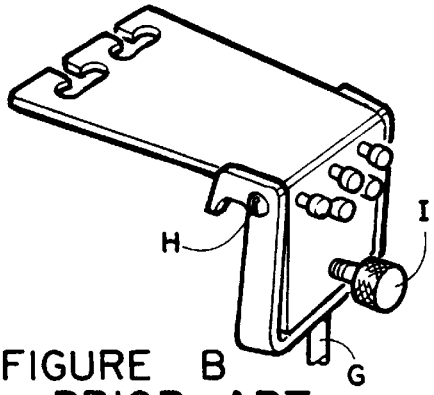
FIGURE B
PRIOR ART
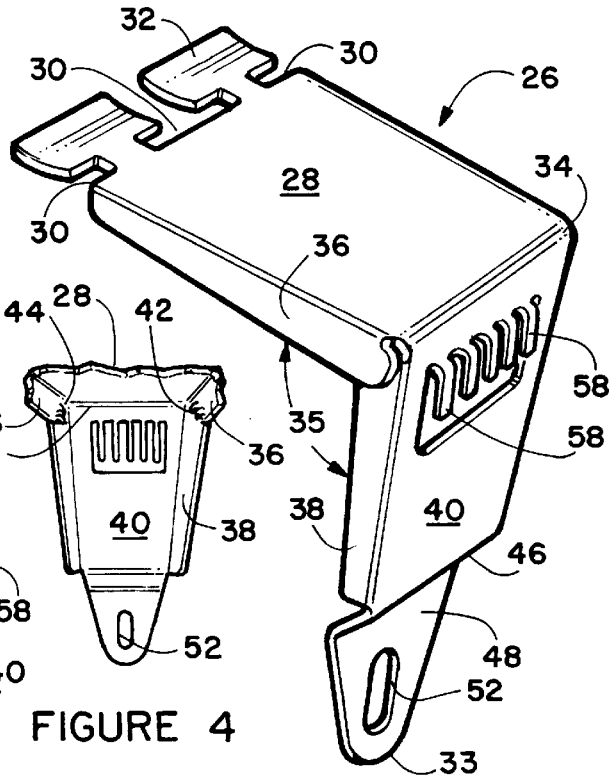
FIGURE 2
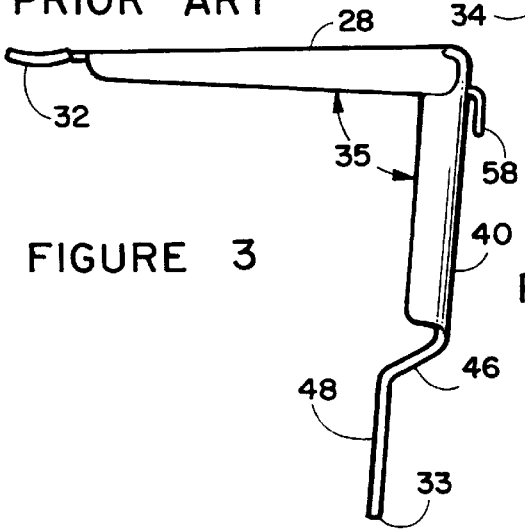
FIGURE 3
FIGURE 4

TAILPIECE FOR A BANJO

BACKGROUND OF THE INVENTION

The invention is directed to and improved tailpiece for supporting the strings on the belly end of a banjo.

Prior art drawing FIG. A teaches a tailpiece C that requires a extension from the drum assembly not shown for the attachment at aperture D. The attachment method requires additional structure to the banjo drum assembly. Also the tailpiece of Prior Art drawing FIG. A has a tendency to fracture along line E from the vibration of the strings.

Another disadvantage of the tailpiece of Prior Art FIG. A is that it is not vertical adjustable along line F.

Prior Art Drawing FIG. B requires additional structure on the drum assembly outer surface for attachment via rod G. The tailpiece of Prior Art drawing FIG. B is vertically adjustable about pivot pin H by adjustment of screw I pressing against an inner fixed in position plate not shown. As discussed above, the string vibrations cause the screw I to loosen changing the tuning of the strings. Also, the pivot pin H has the propensity to break due to the string tension and the vibrations.

There has not been a satisfactory banjo tailpiece until the emergence of the instant invention.

SUMMARY OF THE INVENTION

The tailpiece of the invention is formed from a single piece of metal suitable for the purpose intended. Unlike the showing of Prior Art drawing FIG. A, the tailpiece of this invention has two bends intermediate its ends which create and angle of ninety degrees plus or minus ten degrees. These bends provides the proper angle for the tailpiece relative to the strings. These bends also allow the drum assembly to rest on and extend around the tension loop for the tailpiece attachment to the drum assembly outer surface via a rod passing through the diameter of the drum assembly or fastening means on the drum assembly adjacent to the tailpiece. The tailpiece attachment to the rod is elongated so that the entire tailpiece can be adjusted vertically relative to the drum assembly side surface so as to adjust the banjos tone.

The first severe bend of the tailpiece is angled so that the extended sides of one side of the bend nest over the sides of the other portion of the bend. This is possible because the tailpiece is tapered from end to end or if rectangular one portion adjacent the bend is stepped inward. The sides of the tailpiece are cut typically an inverted "V" and formed so that when bent past ninety degrees there is nesting of the adjacent side walls at the bend occurs. After the bend is made, the inner surface of the adjacent side walls of the bend are fixedly connected by welding, brazing, epoxying, the use of rivets or the like to prevent breaking as discussed above due to the vibration of the strings.

An object of this invention is to provide a tailpiece for a banjo that will not fracture after prolonged use due to vibration.

Another object of this invention is to provide an elongated tailpiece to drum assembly connection that allows selected vertical positioning of the tailpiece relative to the upper drum assembly surface for tone adjustment.

These and other object of this invention will be apparent from the following description taken in conjunction with the accompanying drawings in which:

BRIEF DESCRIPTION OF THE DRAWING FIGURES

Figure Prior Art A depicts an existing tailpiece for a banjo;

Figure Prior Art B depicts a second existing prior art tailpiece for a banjo;

FIG. 1 is a perspective showing of the drum assembly portion of a banjo;

FIG. 2 is a perspective showing of the tailpiece of the invention;

FIG. 3 is a side view of the tailpiece of the invention; and

FIG. 4 is a bottom view of a cutaway portion of the tailpiece of the invention.

DETAILED DESCRIPTION OF THE PREFERRED EMBODIMENT

FIG. 1 depicts a standard banjo 10 showing a portion of the neck 12, strings 14, bridge 16, drum assembly surface 18, drum assembly 20, tension screws 22, tension loop 24 and a tailpiece 26.

The drawings FIGS. 2–4 depict various views of the tailpiece 24 of the invention. The inadequate of the prior art showings of the tailpieces of Prior Art FIGS. A and B are discussed above.

Referring now specifically to drawing FIGS. 2–4, FIG. 2 depicts a perspective showing of the improved tailpiece 26 of the present invention. The tailpiece comprises a flat portion 28 having the string guides 30 at the distal end 32 and a second portion 40 formed by bend 34. The bend at 34 forms an angle 35 in the range of eighty to one hundred degrees.

The tailpiece can be either tapered or rectangular from end 32 to end 33. The only requirement is that the edges 36 before the bend 34 of either overlap the edges 38 of the portion 33 of the tailpiece below the bend 34.

It should be understood that the edges at 36 and 38 are cut so that the bend shown can be made in a smooth manner. Generally an inverted V cut (not clearly shown) is made so as to provide a smooth bend at 34.

Referring now to drawing FIG. 4, the overlapping edges 36 and 38 at the inside of the bend are fixedly attached together as for example and not by way of limitation a weld bead, brazed, epoxyed, rivets or by any other convenient manner between the adjacent nested sides 36, 38 to strengthen the bend so as not to vibrate and break as discussed in the above description of the tailpiece of the Prior Art A showing.

A second bend 46 is shown clearly in drawing FIG. 3 that positions the bottom portion 48 of the tailpiece 26 inward from and parallel to portion 40 of the tailpiece. An elongated aperture 52 is located in portion 48 of the tailpiece. As for example and not by way of limitation a bolt 54 or any other convenient means, see drawing FIG. 1, attaches the tailpiece to the drum assembly. The arm 12 attaches to the drum assembly in a similar manner. The elongation of aperture 52 allows the tailpiece to be vertically adjusted to vary the tone of the banjo. The aperture 58 has sufficient elongation to provide a sufficient tone range by vertical adjustment.

String attachment hooks 58 are shown on portion 40 of the tailpiece.

The above described arrangements and methods illustrate a small number of many possible specific embodiments of this invention. Numerous and varied other arrangements and methods can readily be devised in accordance with principles disclosed, by those skilled in the art without departing from the sprit and scope of the invention.

We claim:

1. A tailpiece for a banjo having a string guide and string hook attachment members comprising:

a tapered base portion having a first and second end, said tapered base portion having a first bend intermediate said first and second end, said first bend resulting in an angle in the range of eighty to one hundred degrees between a first portion of said base having said string guides and a second portion of said base having said string attachment member, a second bend intermediate said first bend and the second end of said base portion for positioning the distal end of said second portion inward toward said first end of said tailpiece and parallel with the adjacent surface of said second portion of said tailpiece immediately below said first bend, an elongated aperture in said second portion of said tailpiece adjacent to said second end of said tailgate for attachment to said banjo.

2. The invention as defined in claim 1 said tailpiece further comprising side surfaces, said side surfaces nest at said first bend one within the other forming a smooth first bend.

3. The invention as defined in claim 2 wherein a weld bead is positioned on the inside of said first bend between each of the adjacent side surfaces fixedly attaching said adjacent side surfaces together at said bend.

4. The invention as defined in claim 1 wherein said tailpiece is tapered from end to end.

5. The invention as defined in claim 1 wherein said tailpiece is rectangular.

* * * * *